United States Patent [19]

Beliveau

[11] Patent Number: 4,557,093

[45] Date of Patent: Dec. 10, 1985

[54] INSULATED BUILDING BLOCK

[75] Inventor: Jean L. Beliveau, Magog, Canada

[73] Assignee: EPSM Inc., Granby, Canada

[21] Appl. No.: 579,195

[22] Filed: Feb. 10, 1984

[51] Int. Cl.[4] ..... E04B 2/00

[52] U.S. Cl. ..... 52/405; 52/570; 52/594; 52/598

[58] Field of Search ..... 52/405, 598, 596, 603, 52/612, 570, 594, 431, 309.9

[56] References Cited

U.S. PATENT DOCUMENTS

| | | | |
|---|---|---|---|
| 3,295,278 | 1/1967 | Muhm | 52/223 |
| 3,546,833 | 12/1970 | Perreton | 52/405 X |
| 3,943,678 | 3/1976 | Ehrenberg et al. | 52/461 |
| 3,996,713 | 12/1976 | Haeussler | 52/309 |
| 4,055,928 | 11/1977 | Magerle | 52/596 X |
| 4,190,995 | 3/1980 | Armistead | 52/594 X |
| 4,206,577 | 6/1980 | Moriez et al. | 52/405 |
| 4,370,075 | 1/1983 | Scales | 52/596 X |

FOREIGN PATENT DOCUMENTS

| | | | |
|---|---|---|---|
| 205815 | 9/1920 | Canada | 52/405 |
| 222270 | 8/1922 | Canada | 52/570 |
| 395563 | 5/1941 | Canada | 52/405 |
| 494546 | 7/1953 | Canada | 52/405 |
| 711888 | 6/1965 | Canada . | |
| 721033 | 11/1965 | Canada | 52/405 |
| 797486 | 10/1968 | Canada | 52/405 |
| 901316 | 5/1972 | Canada | 52/405 |
| 967776 | 5/1975 | Canada | 52/405 |
| 1059336 | 7/1979 | Canada | 52/405 |
| 3035312 | 4/1981 | Fed. Rep. of Germany | 52/596 |
| 1205137 | 1/1960 | France | 52/570 |
| 565380 | 7/1957 | Italy | 52/570 |
| 677455 | 8/1952 | United Kingdom | 52/570 |

*Primary Examiner*—Carl D. Friedman
*Assistant Examiner*—Naoko N. Slack
*Attorney, Agent, or Firm*—Schwartz, Jeffery, Schwaab, Mack, Blumenthal & Evans

[57] ABSTRACT

An insulating building block made up of an insulating core and two concrete walls, each cast over one side of the core. The latter comprises a body having opposed parallel flat outer faces, bound by parallel longitudinal edges and parallel side edges, and having a transverse plane normal to the outer faces centrally between the longitudinal edges. Locking protrusions are formed integrally with the body and project from the outer faces. Each protrusion extends from either side of the transverse plane toward the longitudinal edges and terminates short of the longitudinal edges. The protrusions have outer surfaces and lateral edges tapering inwardly between the outer surfaces and the body outer faces. The protrusion side edges further make angles with the transverse plane suitable to facilitate demolding of the core when the core is molded in two half molds having a closure plane co-planar with the transverse plane, aforesaid. Each concrete wall comprises a concrete slab having cavities into which the protrusions are set; this slab having two contiguous edges co-planar with two contiguous edges of the core and two contiguous edges terminating short of the other two contiguous edges of the core, suitable to define therewith L-shaped rabbets for making mortar joints in the use of the building block.

9 Claims, 9 Drawing Figures

INSULATED BUILDING BLOCK

The present invention relates to a core made of heat insulating material for use in a building block and to a building block incorporating such a core.

A main object of the present invention is to provide an improved insulating block of the insulating core is especially made to facilitate its molding in a single piece in one operation without, particularly, involving any difficulties in unmolding it.

Another object of the invention is in the provision of protrusions on opposed faces of the insulating core capable of firmly holding concrete walls when cast over the opposed faces to prevent relative movement between the concrete walls and the insulating core in any directions. Additionally, these protrusions are so made as to avoid the necessity of providing any additional anchoring means between the insulating core and the concrete walls.

A further object of the invention consists in leaving rabbets along two contiguous edges of the block, these rabbets being intended for making mortar joints in the use of the building blocks.

Additionally, another object of the invention resides in providing, along two contiguous edges of the central core of the block, tenons while mortises are provided along the other two contiguous edges. In use, these tenons and mortises cooperate with the like parts of adjacent blocks to provide perfect sealing in the joints while allowing very accurate positioning and adjustment of the blocks without the requirement of special tools.

The latter tenons and mortises further make it possible to assemble the blocks without immediately making the mortar joints and the spaces left by the aforesaid rabbets may be filled with mortar after a certain number of blocks have been assembled and with the use of an automatic mortar gun. The advantage of this procedure is that the making of the joints can be achieved by unskilled labor.

The tenons and mortises provided on the edges of the insulating core are also quite useful in retaining it very accurately at the center of the mold used for casting the concrete.

As to the protrusions on the insulating core which are embedded in the concrete, they serve as anchoring means without reducing the strength of the joints between the insulating material and the concrete material.

Another advantage and object of the present invention is the presence of a mortise in the insulating core along one longitudinal edge of the building block. Thus, when a wall is being built with blocks according to the present invention, the first row of such blocks along the floor on which the wall is to be made is provided with a continuous wooden strip of which the cross-section is the same as that of the block mortises so that the laying of the first row of blocks can be made without having to adjust the blocks one by one thereby automatically providing a first row of blocks having a very straight alignment.

Accordingly, the present invention is herein broadly claimed as a core made of heat insulating material for use in a building block, said core comprising: a body having opposed parallel flat outer faces, each face being bound by parallel longitudinal edges and parallel side edges, said body having a transverse plane normal to said outer faces and essentially centrally between said longitudinal edges; a series of locking protrusions formed integrally with said body and projecting from said outer faces; wherein each protrusion extends from either side of said transverse plane toward said longitudinal edges;

wherein said protrusions have outer surfaces and lateral edges, said protrusion lateral edges tapering inwardly between said outer surfaces and said body outer faces whereby said protrusions are dovetail in cross-sections parallel to said transverse plane, and wherein said protrusion side edges further make angles with said transverse plane suitable to facilitate demolding of said core when said core is molded in two half molds having a closure plane co-planar with said transverse plane.

The side edges of the protrusions may either taper toward one another as they extend in the direction of the longitudinal edges or else they may be parallel and perpendicular to the aforesaid transverse plane.

As to the top edges of the protrusions, away from the transverse plane, they may also taper toward the outer faces of the body in the direction of the transverse plane.

In accordance with one of the aforesaid preferred objects of the invention, the core is formed of two outward panels spaced from one another and having bounding edges which define the previously mentioned parallel longitudinal edges and parallel side edges, the body being further provided with a middle panel between and integral with the outward panels, this middle panel being offset from the outward panel whereby defining the above-mentioned tenons along two contiguous ones of the edges of the body and mortises along the remaining ones to the edges.

Searches made prior to the filling of the present application have revealed the following pertinent patents which, however, fail to disclose the advantageous structural features mentioned above. These patents are Canadian Pat. Nos.: 205,815 of 1920; 222,270 of 1922; 395,563 of 1941; 494,546 of 1953; 711,888 of 1965; 721,033 of 1965; 797,486 of 1968; 920,316 of 1972; 967,776 of 1975; 1,059,336 of 1979; and U.S. Pat. Nos. 3,295,278 of 1967; 3,943,678 of 1976; 3,996,713 of 1976; 4,206,577 of 1980.

Embodiments of the invention will now be described in detail with reference to the appended drawings wherein:

FIG. 1 is a perspective view of an insulating core, according to the invention, while

The illustrated core 1 is made of any heat insulating material such as blown polystyrene or other similar foam plastic material.

Figure 2:
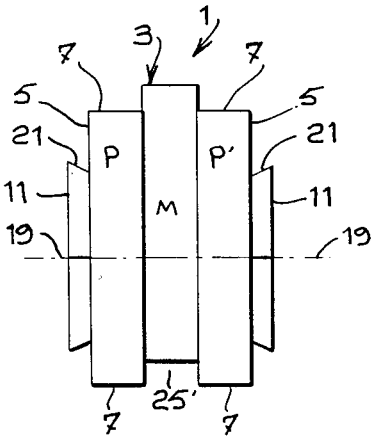
FIGS. 2 and 3 are end and elevation views thereof.
Figure 3:
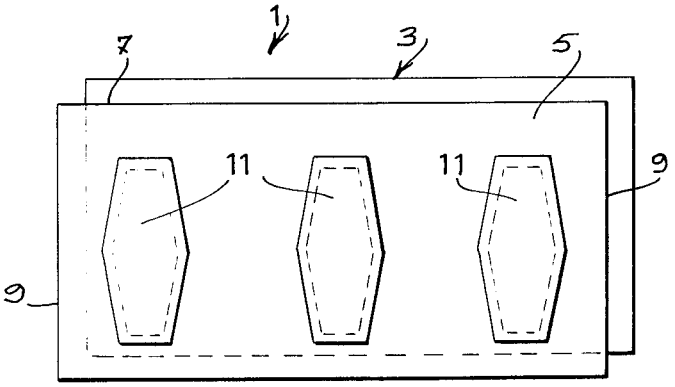

It comprises a body 3 having opposed parallel flat outer faces 5, each bound by parallel longitudinal edges 7 and by parallel side edges 9. The body 3 further has a series of locking protrusions 11 formed integrally with the body 3 and projecting from its outer faces 5. As shown, each protrusion 11 extends from either side of a transverse plane 19 normal to the outer faces 5 and essentially centrally between the longitudinal edges 7, such a plane including the centre lines 13 of the protrusions. The latter extend toward and terminate short of the longitudinal edges 7. As shown, the lateral edges 15 of the protrusions taper inwardly between their outer surfaces 17 and the outer faces 5 of the body 3 so that, viewed in cross-section, the protrusions are shaped as dovetails. It will also be noted, particularly from FIG. 3, that the side edges 15 of the protrusions 11 taper toward one another as they extend in the direction of the longitudinal edges 7. This particular configuration of the protrusions 11 very suitably facilitate demolding of the core 3 when the latter is molded in a mold made of two half molds (not shown) having a closure plane which is co-planar with the transverse plane aforesaid, extending through the centre lines 13 and best shown in FIG. 2 where it is identified by reference numeral 19. FIGS. 2 and 3 clearly show that the two half molds can be very easily moved away from one another in a direction perpendicular to the plane 19.

With respect to the lateral or side edges 15 of the protrusions, it will also be appreciated from FIG. 3 that they can be parallel and perpendicular to the transverse plane 19. However, the side edges 15 are preferably slightly tapered as shown.

Finally, the protrusions 11 preferably have their top edges 21 tapering toward the outer faces 5 of the body 3 in the direction of the transverse plane 19, this configuration being clearly illustrated in FIG. 2.

Figure 1:
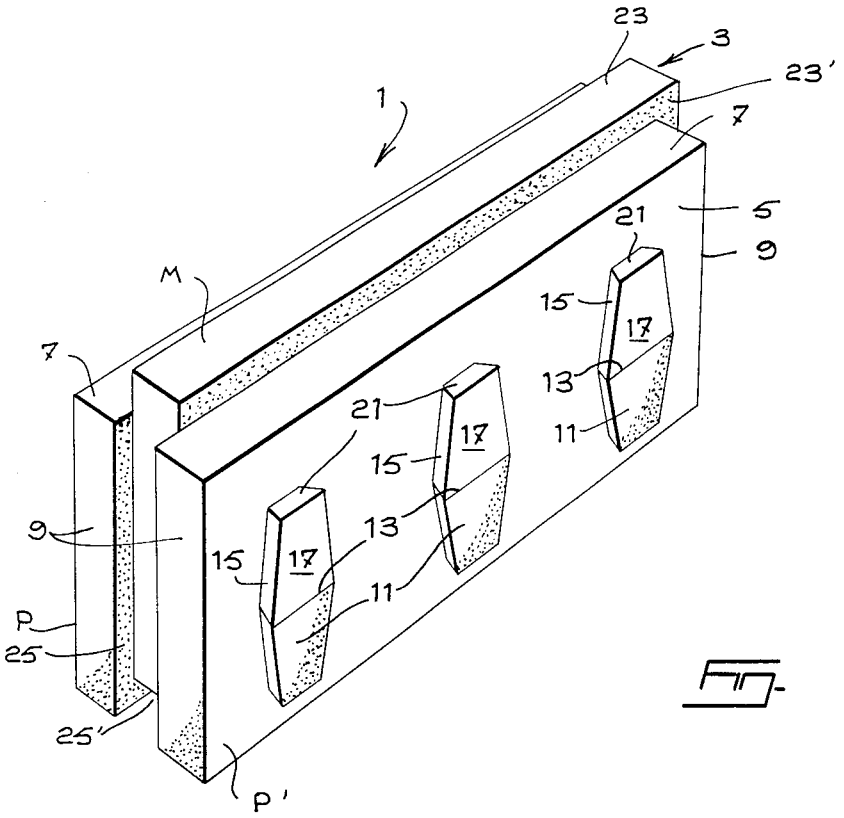

As will be gathered from FIGS. 1, 2 and 3, particularly, the core body 3 is formed of two outward panels P, P', spaced from one another and having bounding edges that define the parallel longitudinal edges 7 and parallel side edges 9; the body 3 being further formed by a middle panel M between and integral with the outward panels P, P'. The middle panel M is offset from the outward panel P, P', whereby defining tenons 23, 23', (FIG. 1) along two contiguous edges of the body 3 and mortises 25, 25' along the remaining edges of the body 3. This middle panel M is equal in size to the outward panels P, P'.

Figure 4:
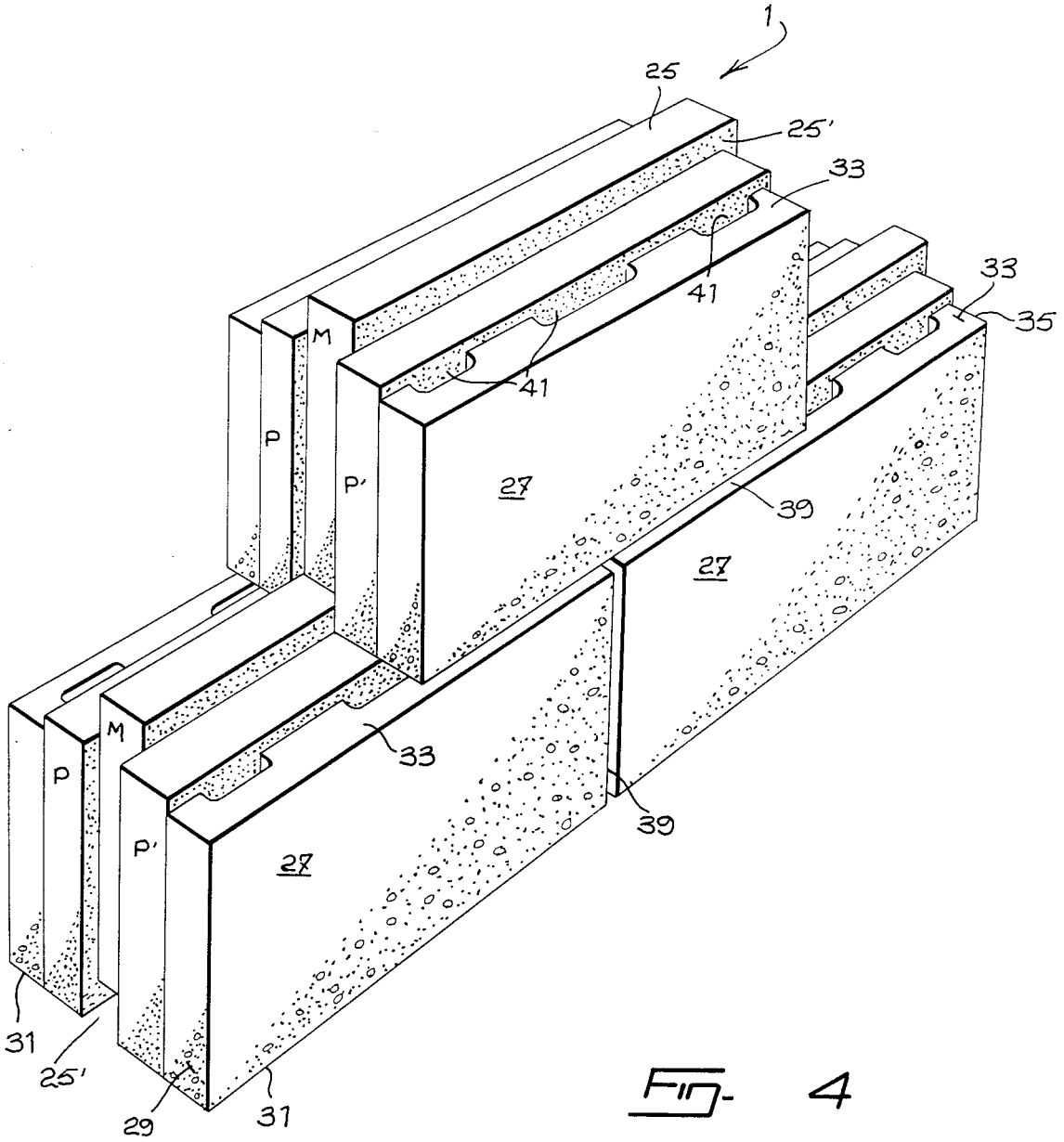
FIG. 4 is a perspective view of three assembled building blocks, according to the invention.
Figure 5:
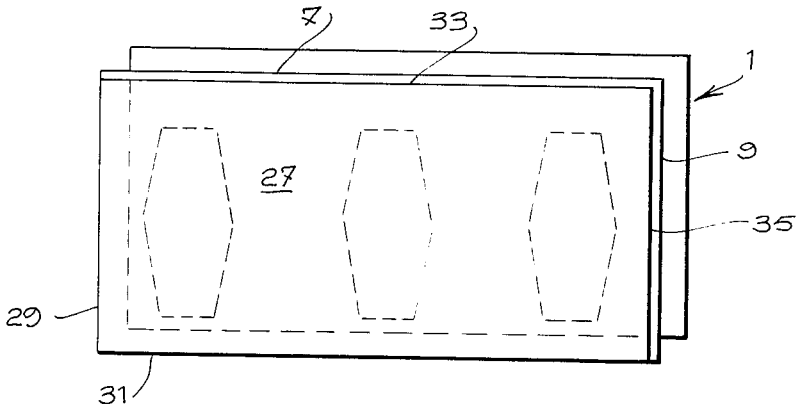
FIG. 5 is a side elevation view of a building block according to the invention.

With reference to FIGS. 4 and 5, the insulating building block is completed by the addition of two concrete walls 27 cast over the outer faces 5 of the core 1. The concrete walls 27 are in the form of slabs having cavities into which the protrusions 11 are set.

Figure 7:
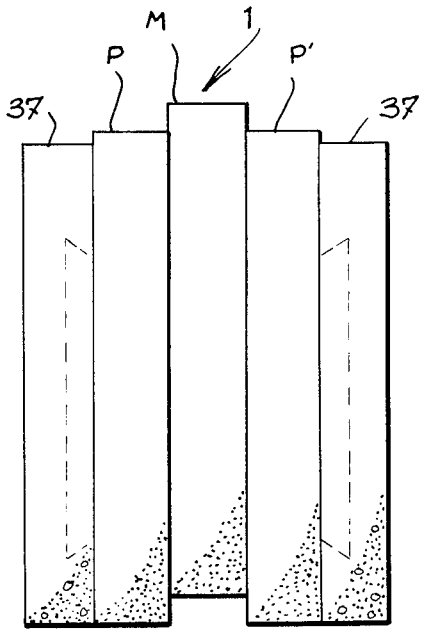
FIG. 7 is an end view of the blocks of FIGS. 5 and 6.

As best shown in FIGS. 4 and 5, each concrete wall or slab 27 has two contiguous edges 29, 31, which are co-planar with two contiguous edges of the core 1 and two contiguous edges 33, 35, which terminate short of the other two contiguous edges of the core 1 and are therefore suitable, as shown in FIG. 4, to make L-shaped rabbets 37 (FIG. 7) defining voids 39 for making mortar joints in the use of the building block, as clearly illustrated in FIG. 4.

Notches 41 are also formed along one of the longitudinal edges 33 of each slab 27, these notches serving for the handling of the blocks by the insertion of fingers therein on opposite sides of the core body 1.

Apart from the ease with which the core 1 may be demolded, as mentioned above, the building block further provides for accurate and easy assembling as is clearly shown in FIG. 4. With reference to the same figure also, the bottom mortises 25' of cores 1 may be advantageously used for setting the bottom row of building blocks along a wooden strip (not shown) fixed to the floor on which a building wall is to be erected. Such a wooden strip makes it possible to very accurately and easily set the building blocks in position.

FIG. 4 also clearly illustrates how the particular construction of the core 1 affords a very appropriate sealing across a wall made with such blocks.

Figure 6:
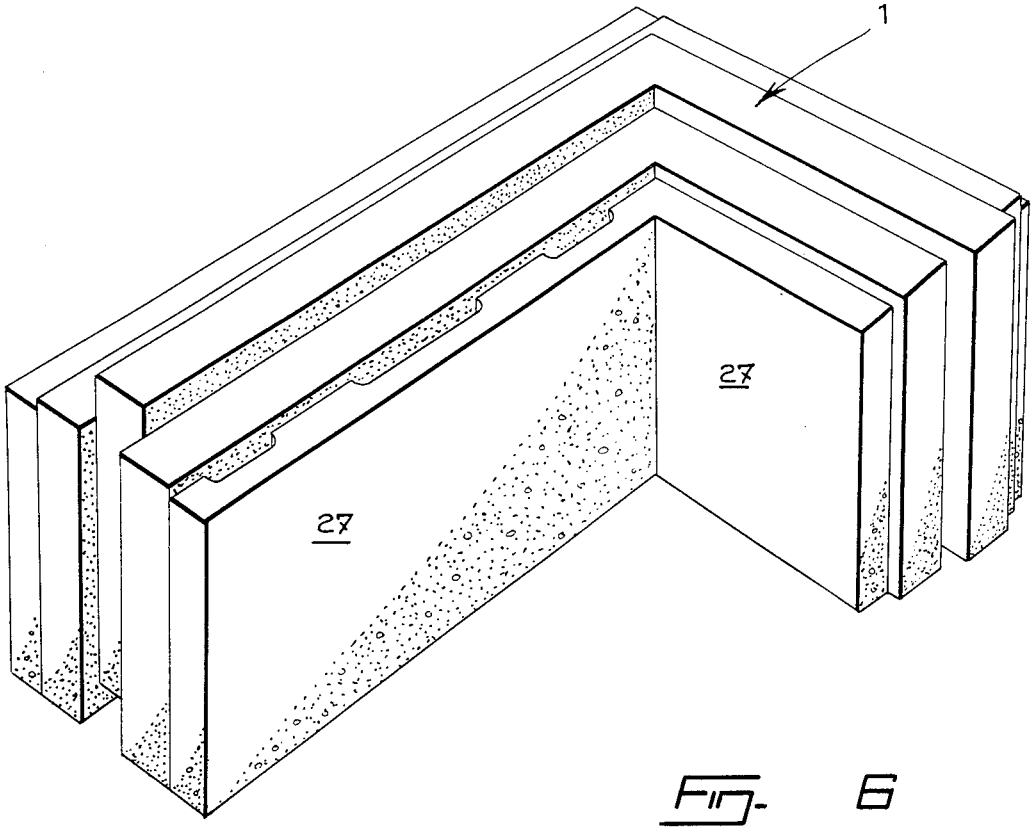
FIG. 6 is a perspective view of a corner block incorporating the inventive features of the block of FIG. 5.

FIG. 6 illustrates the construction of a corner block and it will be appreciated that this corner block is of identical construction as that previously described except that it bends at 90° along a shorter length equal to half the full length of a straight block.

Figure 8:
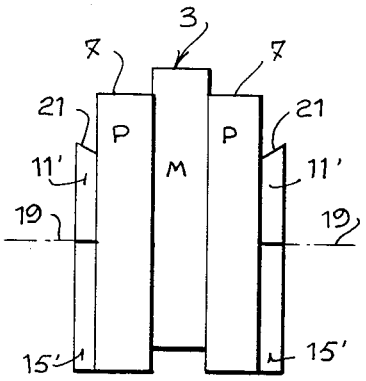
FIGS. 8 and 9 are end and elevation views of a core according to a modified form.
Figure 9:
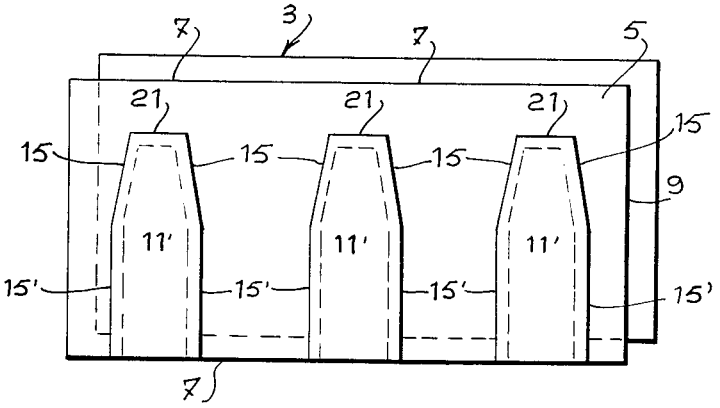

The insulating core 3 shown in FIGS. 8 and 9 is quite similar to that shown in FIGS. 2 and 3 and only differs in the shape of the lower part of the core protrusions 11'. As best illustrated in FIG. 9, the protrusion side edges 15 taper toward one another on one side of the central plane, as in FIGS. 2 and 3, but are parallel to one another as at 15' and are then perpendicular to the transverse plane 19. It will be seen also that the edges 15' are carried down to the lower longitudinal edge 7 rather than terminating short thereof as do the top edges 21 of the side edges 15 with respect to the top edge 7.

The advantage of the insulating core of FIGS. 8 and 9 is that the concrete walls 27 (FIG. 4) can be molded separately with the required cavities and mounted over the insulating core 3 only at the building site by sliding the concrete walls 27 so that the protrusions 11 enter into the concrete wall cavities. In view of the parallelism of the side edges 15', the shape of this modified core is just as suitable to facilitate demolding as the core of FIGS. 1, 2 and 3.

I claim:

1. A core made of heat insulating material for use in a building block, said core comprising:

a body having opposed parallel flat outer faces, each face being bound by parallel longitudinal edges and parallel side edges, said body having a transverse plane normal to said outer faces and essentially centrally between said longitudinal edges;

a series of locking protrusions formed integrally with said body and projecting from said outer faces;

wherein each protrusion extends from either side of said transverse plane toward said longitudinal edges;

wherein said protrusions have outer surfaces and lateral edges, said protrusion lateral edges tapering inwardly between said outer surfaces and said body outer faces whereby said protrusions are dovetail in cross-sections parallel to said transverse plane;

wherein said protrusion lateral edges further make angles with said transverse plane suitable to facilitate demolding of said core when said core is molded in two half molds having a closure plane co-planar with said transverse plane, and wherein said protrusion lateral edges are parallel to each other and perpendicular to said transverse plane, on one side of said transverse plane, and taper toward one another on the other side of said plane to terminate short of the respective longitudinal edge.

2. A core as claimed in claim 1, wherein each of said protrusions has a top edge tapering toward said body outer face in the direction of said transverse plane.

3. A core as claimed in claim 1, wherein said body is formed of two outward panels spaced from one another and having bounding edges defining said longitudinal edges and side edges, said body being further formed by a middle panel between and integral with said outward panels, and wherein said middle panel is off-set from said outward panels whereby defining tenons along two contiguous ones of said edges and mortises along the remaining ones of said edges.

4. A core as claimed in claim 3, wherein said middle panel is equal in size to said outward panels.

5. An insulating building block made up of an insulating core and two concrete walls, each cast over one side of said core, wherein (A) said core comprises:

a body having opposed parallel flat outer faces, each face being bound by parallel longitudinal edges and parallel side edges, said body having a transverse plane normal to said outer faces and essentially centrally between said longitudinal edges;

a series of locking protrusions formed integrally with said body and projecting from said outer faces;

wherein each protrusion extends from either side of said transverse plane toward said longitudinal edges;

wherein said protrusions have outer surfaces and lateral edges, said protrusion lateral edges tapering inwardly between said outer surfaces and said body outer faces whereby said protrusions are dovetail in cross-sections parallel to said transverse plane;

wherein said protrusion side edges further make angles with said transverse plane suitable to facilitate demolding of said core when said core is molded in two half molds having a closure plane co-planar with said transverse plane, and wherein said protrusion lateral edges are parallel to each other and perpendicular to said transverse plane, on one side of said transverse plane, and taper toward one another on the other side of said plane to terminate short of the respective longitudinal edge, and wherein (B) each concrete wall comprises:

a concrete slab formed with cavities into which said protrusions are set;

said slab having two contiguous edges co-planar with two contiguous edges of said core and two contiguous edges terminating short of the other two contiguous edges of said core, suitable to define therewith L-shaped rabbets for making mortar joints in the use of said building block.

6. A building block as claimed in claim 5, wherein each of said protrusions has a top edge tapering toward said body outer face in the direction of said transverse plane.

7. A building block as claimed in claim 5, wherein said body is formed of two outward panels spaced from one another and having bounding edges defining said longitudinal edges and side edges, said body being further formed by a middle panel between and integral with said outward panels, and wherein said middle panel is off-set from said outward panels whereby defining tenons along two contiguous ones of said edges and mortises along the remaining ones of said edges.

8. A building block as claimed in claim 7, wherein each of said concrete slabs is formed with notches along one of said edges, terminating short of the adjacent core edge, for the handling of said block.

9. An insulating building block made up of an insulating core and two concrete walls, each cast over one side of said core, wherein (A) said core comprises:

a body having opposed parallel flat outer faces, each face being bound by parallel longitudinal edges and parallel side edges, said body having a transverse plane normal to said outer faces and essentially centrally between said longitudinal edges;

a series of locking protrusions formed integrally with said body and projecting from said outer faces;

wherein each protrusion extends from either side of said transverse plane toward said longitudinal edges;

wherein said protrusions have outer surfaces and lateral edges, said protrusion lateral edges tapering inwardly between said outer surfaces and said body outer faces whereby said protrusions are dovetail in cross-sections parallel to said transverse plane, and wherein said protrusion side edges further make angles with said transverse plane suitable to facilitate demolding of said core when said core is molded in two half molds having a closure plane co-planar with said transverse plane, and wherein (B) each concrete wall comprises:

concrete slab formed with cavities into which said protrusions are set;

said slab having two contiguous edges co-planar with two contiguous edges of said core and two contiguous edges terminating short of the other two contiguous edges of said core, suitable to define therewith L-shaped rabbets for making mortar joints in the use of said building block, and wherein each of said concrete slabs is formed with notches along one of said edges, terminating short of the adjacent core edge, for the handling of said block.

* * * * *